United States Patent [19]

Gottron et al.

[11] 4,275,658

[45] Jun. 30, 1981

[54] SAFING AND ARMING SIGNATURE FOR FUZES

[75] Inventors: Richard N. Gottron, Rockville; Lyndon S. Cox, Silver Spring, both of Md.

[73] Assignee: The United States of America as represented by the Secretary of the Army, Washington, D.C.

[21] Appl. No.: 84,047

[22] Filed: Oct. 12, 1979

[51] Int. Cl.[3] ..... F42C 11/02

[52] U.S. Cl. ..... 102/210

[58] Field of Search ..... 102/210, 223, 224; 73/4 R, 194 C, 194 E, DIG. 4; 310/311, 314, 318, 367, 369

[56] References Cited

U.S. PATENT DOCUMENTS

| | | | |
|---|---|---|---|
| 14,742 | 4/1856 | Smith | 244/3.23 |
| 35,103 | 4/1862 | Mansfield et al. | 244/3.23 |
| 463,922 | 11/1891 | Russell | 244/3.23 |
| 3,239,678 | 3/1966 | Kolm et al. | 102/210 |
| 3,417,699 | 12/1968 | Piper et al. | 102/210 |
| 3,666,976 | 5/1972 | Gourlay et al. | 310/314 |
| 3,757,695 | 9/1973 | Fisher | 102/224 |
| 3,781,575 | 12/1973 | Campagnuolo | 102/207 |
| 3,787,741 | 1/1974 | Gourlay | 102/207 |
| 3,798,474 | 3/1974 | Cassand et al. | 310/367 |
| 3,861,313 | 1/1975 | Campagnuolo et al. | 102/224 |
| 3,900,748 | 8/1975 | Adler | 310/369 |
| 4,005,319 | 1/1977 | Nilsson et al. | 102/210 |

*Primary Examiner*—Charles T. Jordan

*Attorney, Agent, or Firm*—Nathan Edelberg; Robert P. Gibson; Saul Elbaum

[57] ABSTRACT

A recess or cavity is formed on the exterior of a fuze ogive. A piezo-electric tape is positioned within the cavity or recess. Fluctuations in the pressure within the recess, caused by air flow over the exterior of the fuze, will cause the piezo-electric tape to produce an electrical signal or current.

10 Claims, 9 Drawing Figures

SAFING AND ARMING SIGNATURE FOR FUZES

RIGHTS OF THE GOVERNMENT

The invention described herein may be manufactured, used, and licensed by or for the U.S. Government for governmental purposes without the payment to us of any royalty thereon.

BACKGROUND OF THE INVENTION

Projectile and missiles fuzes contain a safety and arming (S&A) device. Historically, this device has been mechanical and was driven by inertial forces reacting to acceleration of the S&A. The S&A must sense two independent "signatures" which attest to proper launch. Commonly used signatures have been setback (linear acceleration) and spin (centrifugal acceleration). Setback acceleration is realized upon firing of the projectile, while spin is realized by means of rifling twist. For projectiles which do not spin, air flow can be used as a second signature.

Use of air flow as a signature as well as a power source for a fuze is known. Devices known in the art involve the use of fluid oscillators mounted internally of the fuze. Ram air is passed into the fuze cavity to power the oscillator. The oscillator then powers a piezo-electric crystal to generate electrical signals or currents. Examples of such devices are found in U.S. Pat. Nos. 3,666,976 to Gourlay et al; 3,757,695 to Fisher; 3,781,575 to Campagnuolo; 3,787,741 to Gourlay; 3,861,313 to Campagnuolo et al; and 4,005,319 to Nilsson et al. These devices are somewhat complex in their structure and rather costly to manufacture. Further, they occupy a substantial amount of space in the interior of the fuze, where space is at a great premium.

OBJECTS OF THE INVENTION

An object of the invention is to provide a means to generate electrical signals or current in a projectile fuze, which is simple to manufacture at a very low cost.

Another object of the invention is to provide a means to generate electrical power in a fuze which is reliable and has no moving parts.

Still another object of the invention is to provide a power generating means for a projectile fuze which takes up little space within the fuze ogive, and is adaptable to any size fuze.

SUMMARY OF THE INVENTION

The fuze of the present invention is formed with a recess or cavity on its exterior surface. A piezoelectric tape is positioned within the recess or cavity. Pressure variations induced by airflow over the cavity cause the piezoelectric tape to generate a control or power signal.

DESCRIPTION OF THE PREFERRED EMBODIMENT

Figure 1:
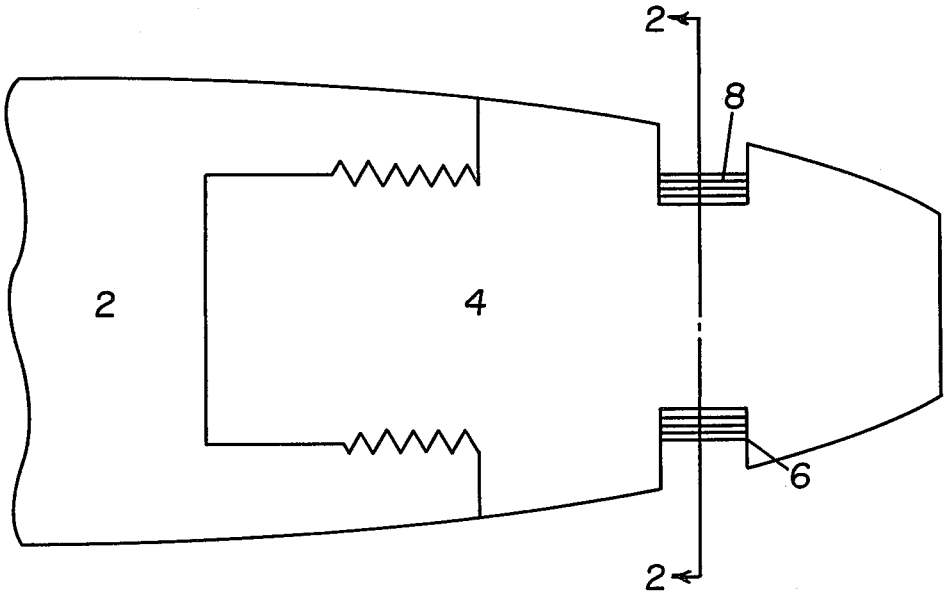
FIG. 1 shows a fuze ogive incorporating essential features of the invention.

FIG. 1 shows a projectile to having attached to the leading end thereof a fuze 4. The fuze has on its exterior a recess or cavity 6, within which is positioned piezoelectric element 8.

Figure 2:
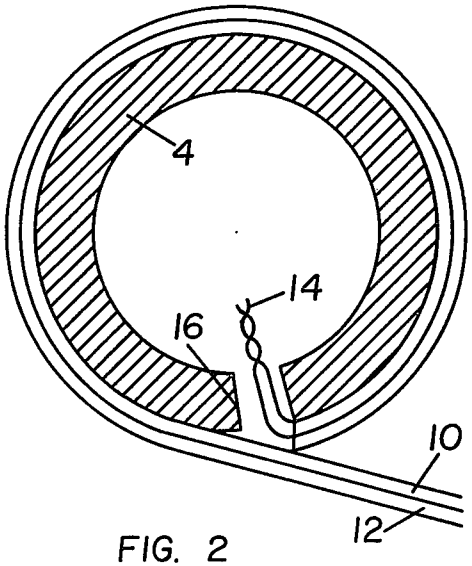
FIG. 2 is a sectional view along line 2—2 of FIG. 1.

FIG. 2 shows in greater detail the arrangement of the piezoelectric element. The element consists of a piezoelectric tape 10 and an adjoining insulating tape 12. The tapes are wound about the fuze 4 at the base of the recess 6. Leads 14 attached to the metalized electrodes of the piezoelectric tape enter the fuze through opening 16. The tape may be wound about the fuze any number of times, as will be explained below.

The piezoelectric tape consists of a polyvinylidene flouride (PVF2) or other piezoelectric film along with an insulating film, as shown in FIG. 2. The PVF2 would be polarized and have metallized electrodes either on it or as foils between layers of the polymer films. The electrical lead wires 14 are attached to the electrodes and carry signals generated by the tape to circuits internal to the fuze. The tapes and the electrodes would be adhesively bonded in the recess to cover the lead wire hole 16 and, in effect, seal the hole and keep out water and dirt.

The signal amplitude available from this sensor is proportional to the pressure amplitude experienced by the tape, the volume and the specific activity of the piezoelectric material. The electrical power available is dependent in turn upon signal amplitude, load, and impedance (both electrical and mechanical). The signal amplitude must be at a minimum large enough to provide air speed sensing for the fuze.

Figure 3:
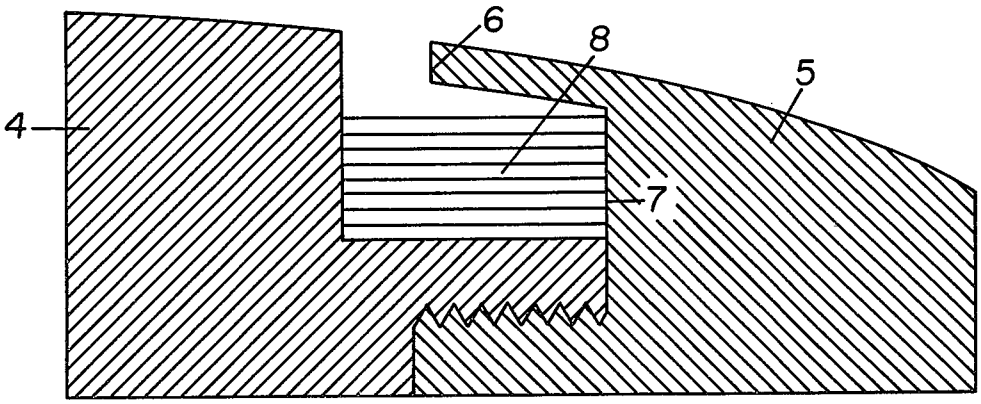
FIG. 3 shows a modified form of the recess or cavity.

With proper design, this transducer could generate enough power to provide electric current to the circuits of an electronically operated fuze. FIG. 3 shows an embodiment of the invention designed to increase the volume of piezoelectric material in the fuze recess, thereby increasing the power output. In the embodiment of FIG. 3, the fuze 4 comprises an end cap 5 threadedly secured to the main portion of the fuze. Recess 6 comprises a circumferential opening between the two parts 4 and 5 of the fuze, and has a fixed dimension in the axial direction. The lower, interior portion of the recess 7 has a greater dimension in the axial direction, to allow space for a greater volume of piezoelectric tape 8. It can be seen that tape 8 may be wound upon the fuze 4 prior to securing the cap 5 thereon.

The fuze electronics should sense a particular frequency or range of frequencies to assure that air flow, rather than electromagnetic interference, is sensed by the piezoelectric tape. This would provide an increased margin of safety in handling of the projectiles prior to the actual firing thereof. Fortunately, as will be described below, the pressure oscillations due to air flow over the recess occur at predictable frequencies. This will permit the safety of the system to be achieved.

Figure 6A:
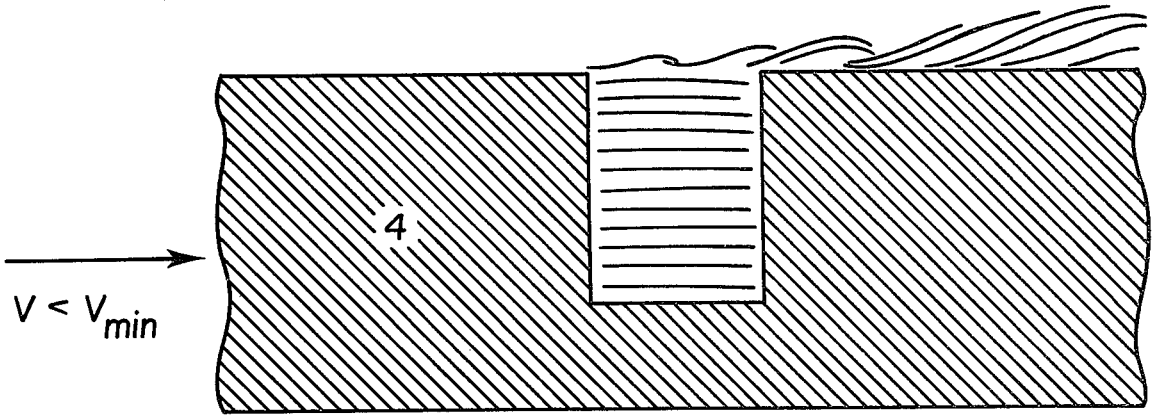
FIG. 6A, 6B, and 7 are illustrative of the manner in which air flows over the recess or cavity in the fuze.
Figure 6B:
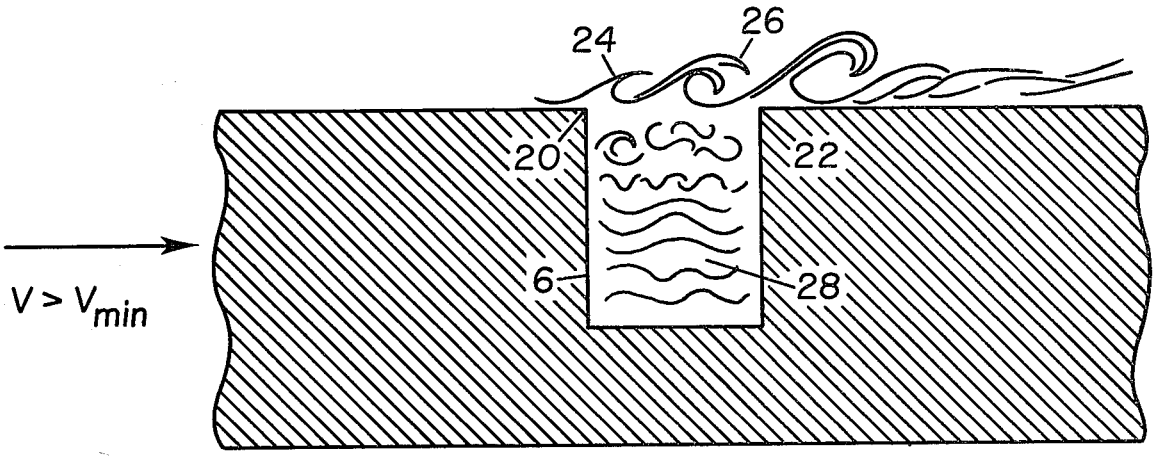
Figure 7:
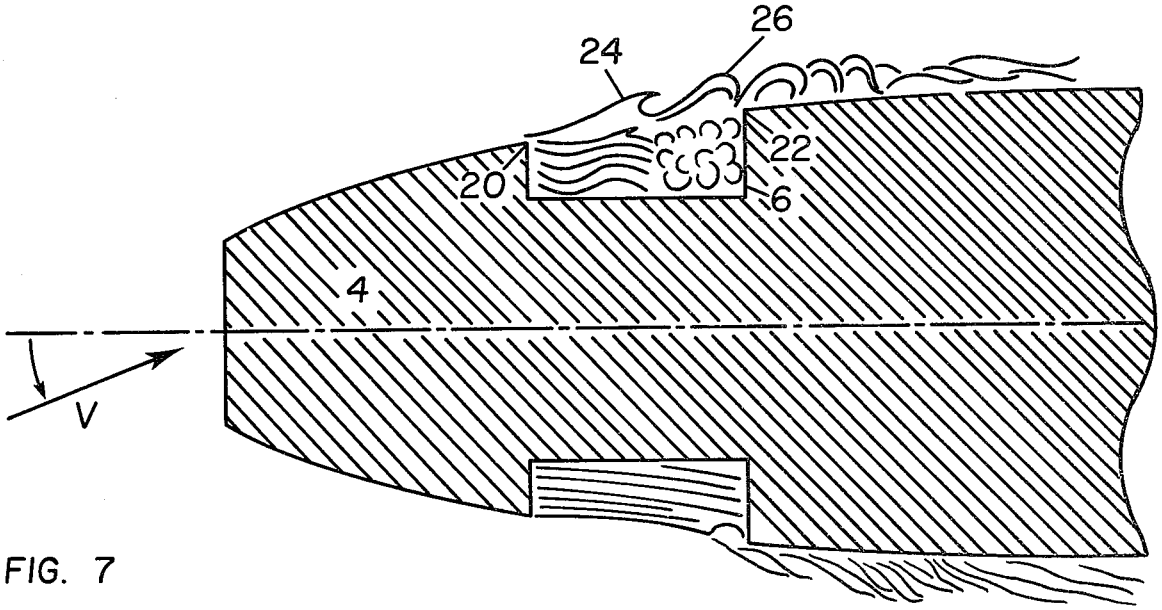

The manner in which the pressure oscillations in the cavity or recess are generated by air flow will now be described, with reference to FIGS. 6 and 7.

Figure 4:
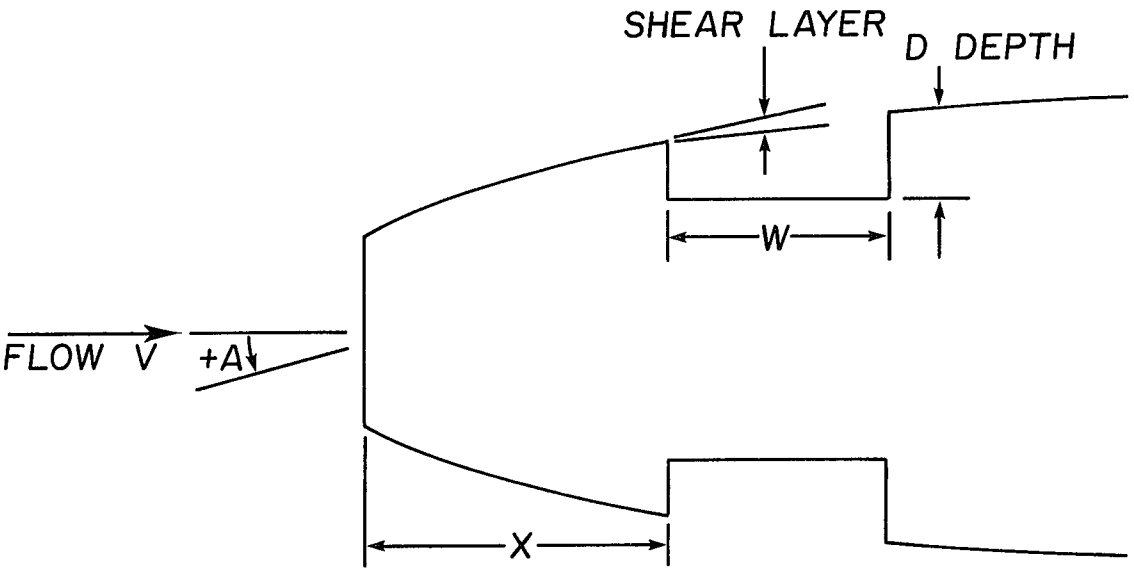
FIG. 4 is a schematic view of a fuze of the invention showing the nomenclature used to describe the manner in which the device of the invention operates.

FIG. 4 illustrates the various terms and nomenclature which will be used in describing the interaction between the fuze and the atmosphere. As can be seen, D represents the depth of the cavity in the the exterior of the fuze, while W represents the axial length of the recess. X represents the distance between the leading edge of the fuze and the foremost, or upstream corner of the recess.

As the projectile passes through the atmosphere, the fuze will experience rapid air flow over the exterior thereof. The shear layer along the exterior of the fuze grows, or increases in depth in a direction perpendicular to the fuze surface. When the shear layer separates from the fuze at the upstream corner 20, instabilities in the form of large scale organized vortex structures 24 are formed, and propagate across the opening of the recess 6. As these structures propagate downstream, they are amplified almost exponentially, as seen at 26, due to the growth of the cavity shear layer. These large structures are responsible for the pressure fluctuations inside the cavity.

At some point along the length of the fuze, the laminar flow over the leading tip of the fuze will begin to separate from the fuze body. As the air speed of the projectile increases, the velocity V of the air flow over the fuze surface correspondingly increases. As V increases, the point of the laminar layer separation moves closer to the leading tip of the fuze. For a given set of dimensions D, W and X there is a minimum velocity V below which no pressure oscillations will occur in the cavity, as shown in FIG. 6A. When this minimum velocity is exceeded, as shown in FIG. 6B, pressure oscillations are generated. For a given flow, a minimum cavity width $W_{min}$ exists below which no strong cavity oscillations are present. Experimented results show that $W_{min}$ when the cavity shear layer is turbulent, is greater than when the cavity shear layer is laminar.

When the air flow over the projectile is parallel to the axis of the fuze, the pressure fluctuations are equal throughout the entire periphery of circumferential cavity 6. This is due to the fact that the formation of the large vortex structures is symmetrical about the fuze body.

Figure 5:
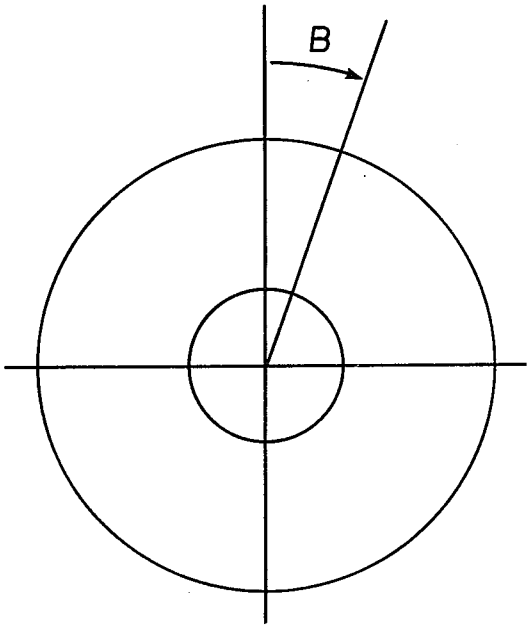
FIG. 5 is a view in the direction shown by flow arrow V of FIG. 4, illustrating angle B, used in describing the manner in which the inventive device operates.

This symmetry is altered somewhat when the flow over the projectile is not parallel to the axis of the fuze body. In FIG. 4, angle A indicates the direction of the air flow over the fuze. Angle B, as seen in FIG. 5, indicates the circumferential position on the fuze body. At an angle A=4°, the structures were destroyed in the vicinity of the circumferential location B=180°, i.e., at the lower side of the cavity, as seen in FIG. 7. On the upper side of the cavity, B=0°, the organized structures were not affected by the angle of attack. The circumferential distribution of the vortex structures in the cavity shear layer indicates that at an angle of attack the coherency of these structures is gradually destroyed as the circumferential position changes from B=0° to B=180°. There is a very close relationship between the coherency of the organized structures in the cavity shear layer and the magnitude of the pressure oscillations inside the cavity. However, the frequency of cavity flow oscillations appears to be independent of the angle of attack for a given cavity configuration and stream velocity V. The frequency of oscillations depends soley on flow velocity, and as V increases above the minimum value necessary to produce oscillations, the frequency will increase almost linearly with velocity.

It is evident that strong oscillations in pressure within the cavity 6 will be present in at least a portion of the circumferential cavity over a range of angular orientations between the flow V and the axis of the projectile in flight. This range appears to be on the order of up to 6–10 degrees, thereby allowing for a certain amount of yawing or deviation of the projectile from its flight path, and for crosswinds.

Extensive experimental data illustrating the interaction between the fuze body, the recess therein, and air flow, is presented in Department of the Army Reports HDL-CR-77-025-1 and HDL-CR-78-025-1. Results of experiments cited in those reports indicate that for a fuze diameter of 2.2 inches, and an air flow velocity of 500 ft/sec, the minimum dimensions necessary to generate pressure fluctuations within the recess 6 are depth of 0.05 inches, width of 0.25 inches, and distance X, from the fuze tip, of 1.25 inches.

Figure 8:
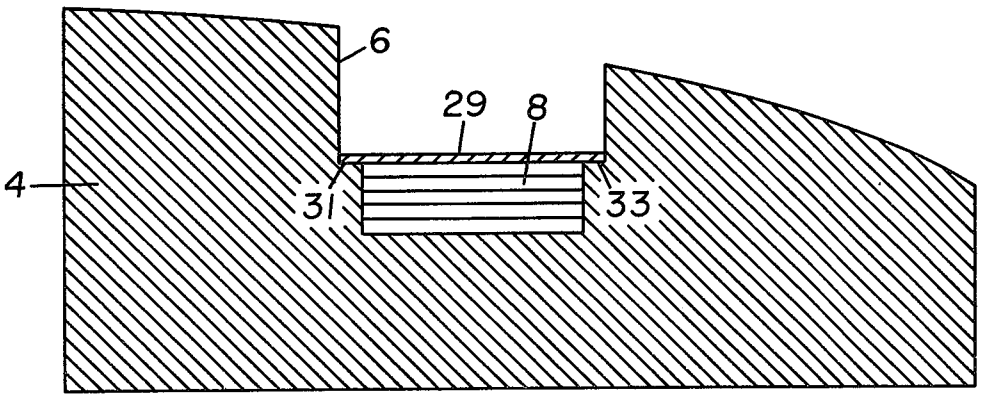
FIG. 8 illustrates yet another embodiment of the invention.

FIG. 8 illustrates another modification of the invention. Recess 6 in ogive 4 is formed with two circumferential shoulders 31 and 33. Piezoelectric tape 8 is wrapped about the ogive in the portion of the recess between the shoulders. A membrane 29, consisting of synthetic material or thin foil, is wrapped about the ogive above the tape 8, and secured, as by bonding, to shoulders 31 and 33. This provides a hermetic seal which acts to protect the piezoelectric tape from moisture, dirt, etc. Although some of the power of the oscillations within recess 6 is dissipated by the membrane 29, since the acoustic level in the recess may be as high as 140 db sufficient power is transferred to tape 8 to generate an adequate signal.

The invention offers a means of obtaining a safing and arming signature for a fuze which is much simpler and less expensive to fabricate than those devices known in the prior art. The inventive device does not intrude significantly into the interior of the fuze and does not require the ingestion of ram air. Thus, the device of the invention may be much more efficiently incorporated into the fuze body, in which space is at a great premium. The cavities or recesses of the invention are very small and may be placed at numerous locations over the fuze exterior. Single or multiple recesses may be utilized. Since the frequency of the oscillation is dependent on the width of the cavity, the frequency is a design parameter, and may be readily chosen by the fuze fabricator. Further, it is not necessary that the cavity be axi-symmetric. The fuze could comprise more than one small cavity in the ogive or projectile body. This would enable one to construct a device which could discriminate between various velocities of air flow, depending on the differing sizes of the various cavities. Such a fuze would enable the projectile to determine when it is traveling at a speed within a given range of velocities, and when it is traveling at a speed above or below such range.

We claim:

1. Means for enabling an object to generate signals when said object is subjected to gaseous fluid flow, said means comprising at least one recess on the exterior of said object, and piezoelectric tape means in said recess for generating said signals in response to pressure variations in said recess.

2. Means as in claim 1 wherein the object has an axis of symmetry, and said at least one recess is arranged symmetrically about said axis.

3. Means as in claim 2 wherein said object has a generally circular cross-section perpendicular to said axis, and said at least one recess comprises at least one recess extending circumferentially around said object.

4. Means as in claim 3 wherein said piezoelectric tape is wrapped about said object more than once forming multiple layers thereof in said recess.

5. Means as in claim 1 or 3 wherein said object is a projectile and said at least one recess is formed on the exterior thereof.

6. Means as in claim 5 wherein said projectile comprises a fuze member, and said recess is formed on the exterior of the fuze member.

7. Means as in claim 5 wherein said means will generate signals only at a particular frequency or range of frequencies.

8. Means as in claim 1, wherein multiple layers of tape are placed in said at least one recess.

9. Means as in claim 1 wherein said at least one recess, at the portion thereof adjoining the exterior portion of said object, has a first dimension measured in the direction of fluid flow, and said recess has a second greater dimension at the interior portion thereof, measured in said direction, whereby the interior cross section of said recess is enlarged with respect to the exterior cross section which is exposed to the fluid flow to increase the quantity of piezoelectric tape which may be positioned in said recess.

10. Means as in claim 1, further comprising means overlying said tape means in said recess provide protection therefor.

* * * * *